US009206657B2

(12) United States Patent
Küttel et al.

(10) Patent No.: US 9,206,657 B2
(45) Date of Patent: Dec. 8, 2015

(54) WEIGHT-BASED INTERLOCK APPARATUS AND METHODS

(75) Inventors: Beat Küttel, Spring, TX (US); John B. Patterson, Cypress, TX (US)

(73) Assignee: CANRIG DRILLING TECHNOLOGY LTD., Houston, TX (US)

( * ) Notice: Subject to any disclaimer, the term of this patent is extended or adjusted under 35 U.S.C. 154(b) by 1002 days.

(21) Appl. No.: 13/296,932

(22) Filed: Nov. 15, 2011

(65) Prior Publication Data

US 2013/0118760 A1 May 16, 2013

(51) Int. Cl.

| | |
|---|---|
| ***E21B 19/16*** | (2006.01) |
| ***E21B 41/00*** | (2006.01) |
| ***E21B 19/06*** | (2006.01) |

(52) U.S. Cl.

CPC ..... *E21B 19/165* (2013.01); *E21B 19/06* (2013.01); *E21B 41/0021* (2013.01)

(58) Field of Classification Search

USPC ..... 166/379, 380, 77.51, 77.53, 85.1

See application file for complete search history.

(56) References Cited

U.S. PATENT DOCUMENTS

| | | | | |
|---|---|---|---|---|
| 4,450,906 | A | 5/1984 | Firmin | |
| 4,676,312 | A * | 6/1987 | Mosing et al. | 166/77.53 |
| 4,842,058 | A | 6/1989 | Sipos et al. | |
| 5,202,680 | A | 4/1993 | Savage | |
| 6,644,413 | B2 | 11/2003 | Adams et al. | |
| 6,742,596 | B2 | 6/2004 | Haugen | |
| 7,073,598 | B2 | 7/2006 | Haugen | |
| 7,096,977 | B2 | 8/2006 | Juhasz et al. | |
| 7,395,855 | B2 | 7/2008 | Ayling | |
| 2007/0131416 | A1 | 6/2007 | Odell, II et al. | |
| 2007/0251701 | A1 | 11/2007 | Jahn et al. | |
| 2008/0202810 | A1 | 8/2008 | Gomez | |

(Continued)

FOREIGN PATENT DOCUMENTS

| | | |
|---|---|---|
| CN | 101487377 | 7/2009 |
| CN | 102146775 A | 8/2011 |
| CN | 101438026 B | 5/2013 |

(Continued)

OTHER PUBLICATIONS

International Search Report and Written Opinion issued for PCT/US2012/064742 dated Dec. 17, 2013, 13 pages.

(Continued)

*Primary Examiner* — Cathleen Hutchins
*Assistant Examiner* — Ronald Runyan
(74) *Attorney, Agent, or Firm* — Haynes and Boone LLP

(57) ABSTRACT

A weight-based tubular interlock apparatus adapted to determine whether a tubular is engagingly gripped by a rig-based hoisting device or a secondary gripping device is described. The apparatus includes at least two gripping mechanisms and an interlock system operatively connected that is adapted to measure a tubular load on at least one of the gripping mechanisms and to compare the tubular load to a predetermined load to deter nine whether the at least one gripping mechanism is gripping the tubular. The gripping mechanism is adapted to release the tubular only when the tubular load meets the predetermined load, upon which a release force sufficient to release the tubular from the gripping mechanism is applied to the tubular relative to the gripping mechanism. Methods of using the interlock apparatus are also described.

31 Claims, 3 Drawing Sheets

(56) References Cited

U.S. PATENT DOCUMENTS

| | | | | |
|---|---|---|---|---|
| 2008/0264648 | A1 | 10/2008 | Pietras et al. | |
| 2011/0048737 | A1 * | 3/2011 | Schneider | 166/380 |

FOREIGN PATENT DOCUMENTS

| | | | |
|---|---|---|---|
| WO | WO 2009/137414 | A1 | 11/2009 |
| WO | WO 2011/109293 | | 9/2011 |

OTHER PUBLICATIONS

Brock et al., 2 Million-lbm Slip-Based Landing String System Pushes the Limit of Deepwater Casing Running, Offshore Technology Conference paper, abstract found at: http://www.onepetro.org/mslib/servlet/onepetropreview?id=OTC-18496-MS&soc—OTC (2007).

Blohm + Voss Oil Tools, "Center Latch Elevator Side Door Elevator Single Joint Center Latch Elevator," Version: 05/ Oct. 2010.

Blohm + Voss Oil Tools, "Elevator/Power Slip Combinations Elevator/Spider Combinations," Version: 07 Oct. 2010.

Blohm + Voss Oil Tools, "VES-SD Elevator," Version: 10/ Oct. 2010.

Blohm + Voss Oil Tools, "Air-operated Power Slip," Version: 09/ Jan. 2011.

Blohm + Voss Oil Tools, "Rotary drill pipe and casing slips," Version: 13/ Jan. 2011.

* cited by examiner

WEIGHT-BASED INTERLOCK APPARATUS AND METHODS

FIELD OF THE INVENTION

The present invention relates to an apparatus and methods for ensuring that a tubular joint or string is gripped by at least one of a rig-based hoisting device and a gripping device. More particularly, the invention relates to an interlock system that releases the tubular joint or string only when a tubular load on the gripping mechanism meets the predetermined load based on weight and only after a release force is applied.

BACKGROUND OF THE INVENTION

During tubular running or makeup/breakout operations, the top drive and a rig floor device must work in tandem to ensure safe casing running, that is, at least one of them must engage and grip the tubular and tubular string at any given time during casing assembly or disassembly. Typically, an operator located on the rig platform controls the top drive and the floor device by inserting or removing slips by hand, or with manually operated levers that control fluid power to slips that cause the top drive and floor device to retain the tubular. At any given time, an operator can inadvertently drop the tubular by executing the wrong operation (i.e., moving the wrong lever or incorrectly reading the controls, improper installation of a gripping device, etc.). Extensive damage and delays in a drilling operation can result. There have been some attempts at improved safety through the use of added interlock systems (See, e.g., U.S. Pat. Nos. 6,742,596; 7,073,598; and U.S. Publication No. 2008/0264648), but these are deficient for one or more reasons, such as inaccurate signals from a conventional interlock system or a latch that doesn't properly hold the weight of a tubular.

There is a need therefore, for an interlock system adapted for use with a top drive and floor device to prevent an accidental release of a tubular. There is thus a need for an interlock system that prevents a rig floor device or a top drive from disengaging a tubular or tubular string when these components are not gripped.

SUMMARY OF THE INVENTION

The present invention relates to a weight-based tubular interlock apparatus adapted to determine whether a tubular is engagingly gripped by a rig-based hoisting device or a gripping device. The apparatus includes a gripping mechanism operably associated with a hoisting device or a rig floor device that is adapted to grip the tubular so as to support the weight thereof; and an interlock system operatively connected thereto that is adapted to measure an actual tubular load on the gripping mechanism and to compare the tubular load to a predetermined load to determine whether the gripping mechanism is gripping the tubular. The gripping mechanism is adapted to release the tubular only when the actual tubular load is reduced below the predetermined load. Preferably, the apparatus is then further adapted to apply a release force sufficient to release the tubular from the gripping mechanism. In one embodiment, this release force can be at least substantially, and more preferably entirely, axially to the tubular relative to the gripping mechanism. In one embodiment, the release force is at least substantially, and preferably entirely, opposite the tubular load.

In one embodiment, the apparatus also includes at least one counterbalance mechanism, such as a counterbalance cylinder, adapted to provide incremental movement of the tubular that is preferably at least substantially axially, and more preferably entirely axially, relative to a rig-based hoisting device. Preferably, the at least one counterbalance mechanism or cylinder, includes a hydraulic cylinder. The at least one counterbalance cylinder can provide the release force, or a portion thereof. Preferably, however, the counterbalance cylinder measures the tubular load to see if one to five tubulars are being gripped, or measures the presence of a tubular load being gripped if the entire tubular string is gripped, or indirectly measures the presence of a tubular load through the position of the cylinder.

In another embodiment, a controller measures the actual load and calculates the sufficient release force. The release force is less than the force needed to release the actual load, but sufficient to release the predetermined load.

Generally, the condition of the predetermined load is met when at least a second gripping mechanism is engagingly gripping the tubular and carrying at least a majority of the actual load thereof. The second gripping mechanism is preferably operably associated with the rig floor device when the first gripping mechanism is operably associated with the rig-based hoisting device.

In an exemplary embodiment, the interlock system is electronically associated with the gripping mechanism and second gripping mechanism, and is adapted to confirm the actual tubular load is engagingly gripped by at least one of the gripping mechanism and second gripping mechanism before releasing the other of the gripping mechanism and second gripping mechanism.

The actual load on the gripping mechanism may be entirely an axial load. In yet another embodiment, the tubular load meets the predetermined load when the load falls within a range of acceptable loads to confirm the tubular is gripped by a second gripping mechanism.

In a most preferred embodiment, the interlock system is integrally formed with the gripping mechanism so that sensors and other external devices are not required. A drilling rig that includes the present interlock apparatus is also described.

The present invention further relates to a method to ensure that a tubular is engagingly gripped by a rig-based hoisting device or a gripping device. The method includes gripping a tubular with a gripping mechanism operably associated with the rig-based hoisting device (e.g., in a CRT and/or a rig floor device) that is adapted to grip the tubular so as to support the weight thereof; measuring an actual tubular load on the gripping mechanism; comparing the tubular load to a predetermined load; releasing the gripping mechanism's engaging grip on the tubular if the effective tubular load is no greater than the predetermined load. In one embodiment, the method further includes applying a release force to the tubular relative to the gripping mechanism. In another embodiment, the load is entirely an axial load. In yet a further embodiment, the release force may include an axial component.

Preferably, the method includes calculating the release force needed to release the actual load. The method typically includes setting the release force at less than the force needed to release the actual load. In one embodiment, the release force is set to about 5 to 60 percent of the force need to release the actual load so that the release force can be applied to release the tubular from the gripping mechanism when the load is decreased sufficiently.

The release force can be applied in a number of different ways. For example, the release force may be applied in the upwards direction to the tubular (i.e., opposite the tubular load), in a downwards direction to the gripping mechanism (preferably while the tubular is fixed in place), or both.

Generally, a second gripping mechanism grips the tubular sufficiently so that the load on the gripping mechanism is no greater than the predetermined load. The load on the gripping mechanism may be measured by any suitable method. For instance, the load on the gripping mechanism can be measured by a load cell operatively connected to the gripping mechanism, the position of at least one counterbalance cylinder, the measured or calculated force on at least one counterbalance cylinder, or any combination thereof.

The present invention further relates to a method to inhibit or prevent undesired release of a tubular during operation of a rig. The method includes gripping a tubular with a first gripping mechanism operably associated with a rig-based hoisting device; measuring an actual load on the first gripping mechanism; calculating the force required to release the actual load; setting a release force at less than the force required to release the actual load; and applying the release force to the tubular relative to the gripping mechanism, The load is not released unless a second gripping mechanism sufficiently grips the load.

Preferably, a second gripping mechanism is operably associated with a rig floor device and when gripping the tubular load it decreases the load on the first gripping mechanism so that the release force can be applied to release the tubular from the first gripping mechanism. In one embodiment, the release force is set to about 10 to 90 percent of the force need to release the actual load so that the release force can be applied to release the tubular from the first gripping mechanism when the load is decreased sufficiently. Typically, the release force is applied in the upwards direction to the tubular, a downwards direction to the gripping mechanism, or both. In another embodiment, the release force may be radially inwards or outwards, preferably opposite from the direction of the tubular load.

In another embodiment, the method further includes gripping the tubular sufficiently with a second gripping mechanism so that the load on the first gripping mechanism is no greater than the predetermined load.

Lastly, the present invention relates to a drilling apparatus that includes a rig-based hoisting device with a first gripping mechanism operatively associated therewith; a second gripping mechanism operatively associated with a rig floor; and an interlock system integrally formed with the first gripping mechanism and second gripping mechanism that is adapted to confirm the actual load of a tubular is engagingly gripped by at least one of the first and second gripping mechanism before releasing the other of the first and second gripping mechanism. The first and second gripping mechanisms are adapted to release the tubular only when the actual load meets the predetermined load, upon which a release force sufficient to release the tubular from the first or second gripping mechanism is applied to the tubular relative to the gripping mechanism. In various preferred embodiments, the release force is applied at least substantially, or preferably entirely, axially; at least substantially, or preferably entirely, radially; or a combination thereof in motion containing both radial and axial components.

In one embodiment, at least one counterbalance cylinder measures the load on the first gripping mechanism. In another embodiment, the release force is less than the force needed to release the actual load, but sufficient to release the predetermined load.

The invention further encompasses a method to inhibit or prevent release of a tubular during rig operation by gripping a tubular with a first gripping mechanism operably associated with a rig-based hoisting device, measuring an actual load on a second gripping mechanism operably associated thereto to determine if the tubular is being gripped, and applying a release force sufficient to release the tubular from the first gripping mechanism, wherein the load is not released unless the second gripping mechanism is gripping the load. In one embodiment, the measured actual load is compared to a preset value to confirm the second gripping mechanism is gripping the tubular. In another embodiment, the method further includes measuring an actual load on the first gripping mechanism; and comparing the measured actual load on the first and second gripping mechanisms to determine that the tubular is sufficiently gripped by the second gripping mechanism before applying the release force.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION OF THE PREFERRED EMBODIMENTS

The present invention minimizes human error, and provides methods and apparatus to minimize or prevent the inadvertent loss of a tubular in a wellbore and the personal and environmental injury that can occur in such circumstances. The apparatus and methods described herein help ensure that either a rig-based hoisting device or a gripping device is gripping the tubular before the grip is released by the other gripping device, and this is preferably achieved through an additional release force required in a particular direction relative to the tubular as an additional safety mechanism. In particular, the release force applied according to the invention described herein is never large enough to release the actual load, unless another gripping device has been determined to be gripping a substantial portion or all of the actual load, e.g., detecting the transfer of load from one gripping mechanism to another. Because of this, the release force can even be applied before the other gripping device has gripped the tubular load since it will not release until that other gripping device is confirmed to have gripped most or all of the actual load. The rig-based hoisting device includes a gripping device, as well, which can be the same or different from the other gripping device. While any rig-based hoisting device such as a block-and-tackle drawworks or top drive may be used in accordance with the invention, a top drive is referred to herein merely as an example of a suitable rig-based hoisting device. Certain embodiments of the present invention do not require an external interlock device, such as sensors attached to gripping assemblies, but instead use the weight of the tubular to send a signal to a controller that the tubular is properly gripped. Such embodiments advantageously can permit the present interlock apparatus to be integrally formed with the drilling equipment, or the casing running tool equipment, used for making or supporting a borehole.

As used herein, "tubular" may include a single tubular or a tubular string having more than one tubular. For clarity, "tubular" includes a single tubular joint, a plurality of two to five tubular joints, or a tubular string of more than five joints. Exemplary tubulars include casing, drill pipe, tubing, and other wellbore tubulars as is well known to those of ordinary skill in the art.

The application typically describes transferring a tubular load in one direction, but it should be understood that the interlock systems and methods described herein are also equally applicable to the opposite well equipment operations. Thus, the tubular load can be transferred in the opposite direction, which will typically require the opposite movements to those described herein and these will be well understood by those of ordinary skill in the art.

Figure 1:
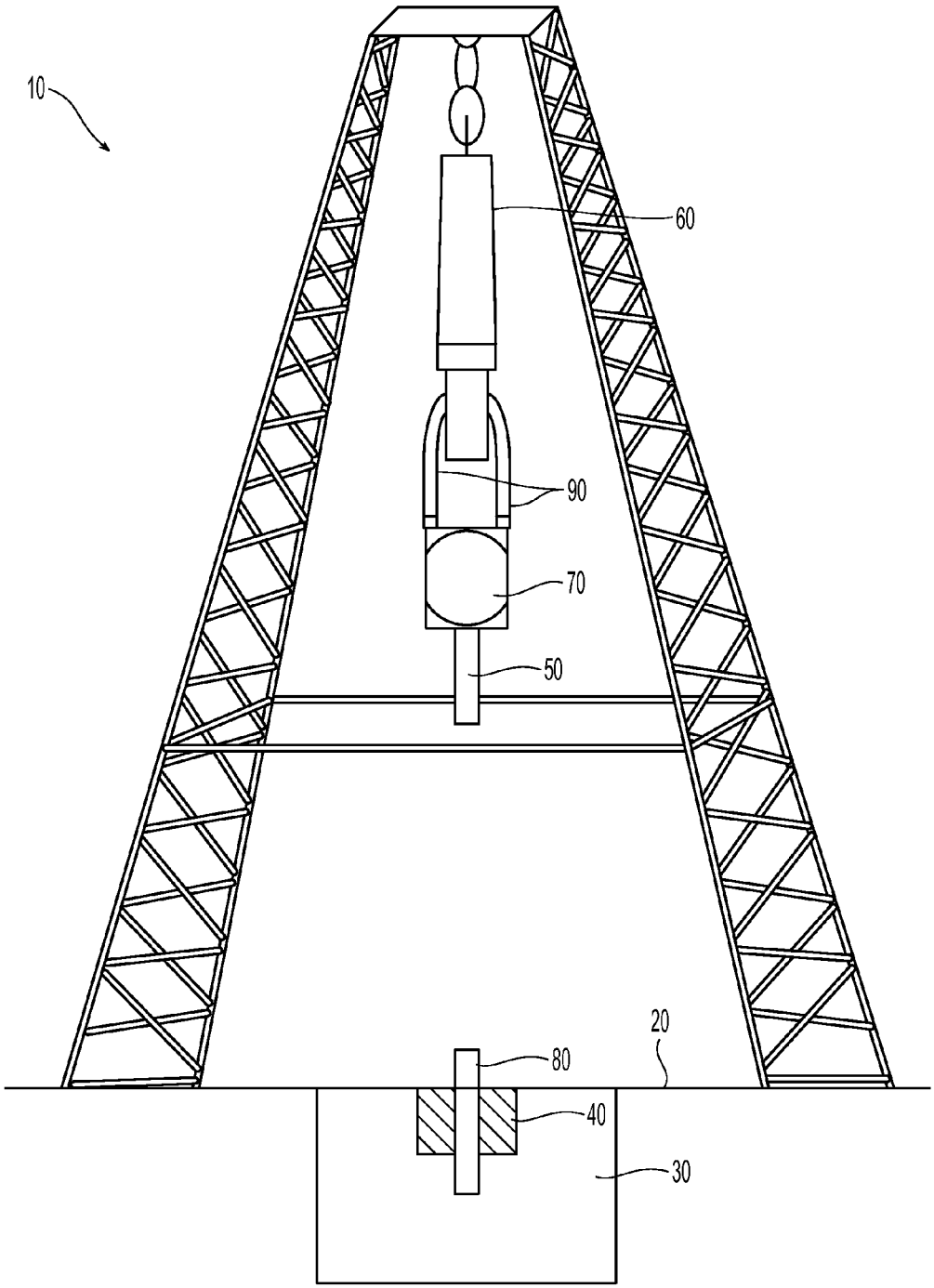
FIG. 1 is an illustration of a preferred embodiment of a weight-based tubular interlock apparatus according to one or more aspects of the present disclosure.

FIG. 1 shows a drilling rig 10 adapted to casing and drilling operations. The drilling rig 10 includes a rig floor 20 and a wellbore 30 therethrough, the center of which is termed the well center. A rig floor gripping device 40 is disposed around or within the wellbore 30, either at the rig floor or adjacent thereto, to grippingly engage the tubular string 80 at various stages of the casing or drilling operation.

The drilling rig 10 includes a top drive 60 positioned above the rig floor 20. In one embodiment, a traveling block holds the top drive 60 above the rig floor 20 and may be caused to move the top drive 60 axially. Other techniques and equipment are well known in the industry for handling a top drive during operations, and any other such suitable technique or equipment for handling a top drive can be used, as well. The top drive 60 includes a motor used to rotate the tubular 50 at various stages of the operation, such as during drilling with drill pipe or casing, or while making up or breaking out a drill pipe or casing connection, etc.

A tubular gripping mechanism 70 is operably connected to the top drive 60, and is typically disposed below the top drive either directly or connectedly as part of or associated with a casing running tool disposed below the top drive. The gripping mechanism 70 or floor gripping device 40 may thus include, or be part of, a casing running tool, an elevator, torque head, or a clamping system, such as slips or wedges or any other method to grip a tubular. The gripping mechanism 70 is used to grip an upper portion of the tubular 50 and transmit torque from the top drive 60 to the tubular 50. In one preferred embodiment, the gripping mechanism 70 and floor gripping device 40 are each a device that includes one or more features described in U.S. Pat. Nos. 7,445,050 and 7,552,764, and U.S. Publication Nos. 2009/0321064 and 2011/0147010, the entire contents of each which is hereby incorporated herein by express reference thereto. Another exemplary gripping assembly can include two half-moon-shaped clamps directed towards each other and inwards onto an outer surface of a tubular to grip the tubular, where pressure is applied like a pair of blow out preventer rams (but without actually modifying the tubular shape and in a releasable manner). Yet another exemplary gripping assembly may include one that is directed outwards from inside a tubular toward two or more inner surfaces of the tubular, with releasably applied force to cause gripping of the tubular. It should be understood that any suitable gripper, or gripping device, each including one or a plurality of gripping components, may be selected by those of ordinary skill in the art for use in association with the interlock described herein.

To makeup the tubular 50 to the tubular string 80, the top drive 60 may be operated to provide torque to rotate the tubular 50 relative to the tubular string 80 held by the floor gripping device 40 and to threadedly engage the tubular 50 and tubular string 80. After the tubular 50 is connected to the tubular string 80, the tubular string 80 may be released from the floor gripping device 40 using the weight-based interlock system and methods described herein.

Thus, after threading, the gripping mechanism 70 is preferably raised to transfer the tubular load from the floor gripping device 40. Once the entire tubular string load is gripped by the gripping mechanism 70, the tubular string may be rotated or moved axially by the top drive 60 or an operably connected device, such as a casing running tool (not shown), to further drill the borehole, run casing, or other desired operation. The tubular string load is then lowered into the wellbore 30 along a substantial portion of the length of the tubular 50 that was added to the tubular string 80, and the floor gripping device 40 then operated to grip the tubular string load. Once the interlock system according to the present invention confirms a suitable engagement of the floor gripping device 40, i.e., transfer of enough of the load from the gripping mechanism 70 to the floor gripping device 40, the gripping mechanism 70 releases the tubular string load so that the top drive 60 and operatively connected equipment (not shown) can be raised or otherwise manipulated for further operations.

To ensure that at least one of the gripping mechanism 70 or the floor gripping device 40 is gripping the tubular at all times, the interlock system is provided. The interlock system in part uses tubular weight to determine if it is safe before releasing either the gripping mechanism 70 or the floor gripping device 40 at different points in the process of running casing, drilling, removing casing, or any other similar oilfield operations. The interlock system releases the grip only when the tubular load on at least one of the gripping mechanism 70 or floor gripping device 40 meets a predetermined load. In one embodiment, the measured (or alternatively in various instances throughout, calculated from a measured value) tubular load must be no greater than the predetermined load for either gripper to release, which indicates that the load on the gripper to be released is held by the other gripper. In another embodiment, the load must be at least the predetermined load to indicate that the load on the gripper that is supposed to be engaging the tubular is greater than the initial load. The method and equipment for weighing the tubular load is not critical and any suitable direct or indirect mechanism known to those of ordinary skill in the art may be used. For example, a load cell at the gripping mechanism 70 or floor gripping device 40 may send load data to a controller, or a load cell between the gripping mechanism 70 or the floor gripping device 40 and their operatively connected equipment may alternatively be relied upon to determine the tubular load when needed. Another example is a pancake-style load cell used at the bottom of one or more of a set of slips to measure the weight on the slips. In one embodiment, it is preferred that a direct weight measurement be used, such as a load-cell, as this may be simpler than an indirect measurement depending on various factors.

In one aspect of the invention, at least one gripping device has the ability to measure actual load (i.e., the master gripping device) and at least one other gripping device is slaved to the measuring-capable device (i.e., the slaved gripping device). Thus, the slaved device can either receive the release force amount and commands to release from the master, or act as purely a device that does not measure weight. The slaved-device can simply receive a duplicate of the measured value of the actual load, which can expedite operation and minimize the need for every gripping apparatus to include a load-measuring device, and in one embodiment, even avoid the need for an additional controller at the slaved-device. A similar embodiment includes having one load cell adapted to control two or more gripping devices that is operably connected to the controller and facilitates transfer of weight, or tubular load, between the gripping mechanisms.

In another alternative arrangement of an interlock system and apparatus of the invention, two load cells may each independently control a gripping mechanism, like two independent interlocking devices that are operably connected to serve as a double-check on each other. For example, a load cell measures a tubular string, and if the weight is detected as being reduced, we know something else took the weight and it was transferred elsewhere. The load cell can be in a rig floor device or a top drive, but is preferably in a top drive in some cases because of more accurate control of associated electronics.

Typically, a controller compares the predetermined load to the actual tubular load, and determines if the tubular load is within acceptable values for release of a gripping mechanism or device. If not, then the gripping mechanism 70 or floor gripping device 40 remains locked and closed, and the controller may initiate remedial action such as by sending a signal to the operator. If the load and predetermined load values are acceptable, then the controller locks the gripping mechanism 70 or floor gripping device 40 in the engaged position. Thus, the predetermined load is achieved only when at least one of the gripping mechanism 70 or floor gripping device 40 hold and grip the tubular. The tubular is at all times either engaged by the gripping mechanism 70 or floor gripping device 40.

In one embodiment, the predetermined load encompasses a range of acceptable loads to confirm that the tubular is gripped. For example, the predetermined load may be about 1 to 30 percent, preferably about 3 to 20 percent, and more preferably about 5 to 15 percent, of the full load of the tubular. Alternatively, the predetermined load may be greater than the initial load to signify that gripper is engaging a longer tubular, and therefore a heavier load.

To facilitate increased handling control of the tubular string, and as a safety precaution, the interlock apparatus and system is preferably configured so that a release force must be applied relatively between the tubular and either the gripping mechanism 70 or floor gripping device 40, or both, to release the grip on the tubular. In one embodiment, the release force is applied in an axial direction, while in another the release force is applied in the radial direction, and in another in both axial and radial directions. By "axial" is preferably meant at least substantially, or entirely, in the direction of the length of the tubular.

The release force may be applied in a variety of ways, including in an upwards or downwards direction to the tubular, in a downwards or upwards direction to the gripping mechanism 70 or floor gripping device 40 relative to the tubular, or both on the tubular and gripping mechanism or device concurrently, or radially inwards or outwards, or in a combination of axially and radially. In an embodiment where the release force is axial, for example, a lifting force may be applied to the tubular, such as by an external device or by lifting the floor gripping device 40, or alternatively the gripping mechanism 70 can be lowered relative to the tubular string 100 (as shown in FIG. 2 and further discussed below), which typically remains at least substantially fixed in place relative to the floor gripping device 40. The top drive 60, any operatively associated equipment with the gripping mechanism 70 or the top drive 60, or any combination thereof, may also be lowered along with the gripping mechanism 70. Alternatively, the top drive 60 may lower the gripping mechanism 70 and concurrently raise the tubular a relatively greater amount than the gripping mechanism 70 is lowered to ensure release and separation of the tubular from the gripping mechanism 70. In one embodiment, counterbalance cylinders 90 provide an upward release force on the tubular. In one embodiment, the release force has only an axial component and no radial component, while in another embodiment the release force has only a radial component and no axial component. It should be understood that the release force may be in one direction (e.g., axially, radially, or both), but the movement that resultingly occurs may be in a different direction. For example, one or more ramps, springs, hydraulic force or hydraulic cylinder, or other comparable device, or any combination thereof, may convert an axial force into a release force that results in both axial and radial movement of a portion of the apparatus, such as the gripping apparatus or the tubular to indirectly affect the gripping apparatus.

In another embodiment, the controller is preprogrammed with acceptable release forces for tubular joints having a particular weight. The controller sets the release force at a level lower than the force required to release a tubular if the tubular is fully held by gripping mechanism 70 or floor gripping device 40. Thus, for instance, the grip of gripping mechanism 70 will not be released unless and until the floor gripping device 40 is gripping the tubular, at which time the load and the force required to release the actual load (also referred to as the "measured load") at the gripping mechanism 70 are decreased to no more than the applied release force by virtue of substantially all or all the tubular weight being held by the floor gripping device 40. The release force is typically set to about 10 to 90 percent of the force needed to release the full tubular load, preferably about 20 to 80 percent, and more preferably about 30 to 70 percent of the full tubular load, so that the release force can be applied to release the tubular from the gripping mechanism when the load is decreased sufficiently by, e.g., a second gripping mechanism supporting most or all of the load. By "most" is typically meant at least half the load or otherwise a sufficient amount wherein the second gripping mechanism will capture all of the load being transferred if the other gripping device releases the tubular or string, thereby taking up the additional load to prevent a dropped tubular or string. While release forces above 90 percent may be used, great care must be taken because problems, such as calculation error or mismeasurement, may cause release before the other gripping device holds sufficient actual tubular load. Similarly, release forces below 10 percent may be used, but care must be taken to avoid friction, calculation error, measurement error, or similar problems such that the device will never release the tubular without external intervention.

For clarity, an exemplary embodiment is set forth. For a tubular string weighing 1000 pounds, presume that a predetermined load of 200 psi is required to release the gripper. The predetermined load can be applied through a hydraulic device, such as a pump or piston, and the predetermined load can thus be calculated in psi or pounds based on the other variables for a given tubular and pump/piston device. The release force can then be set to, e.g., 50 psi, 100 psi, 150 psi or some other value that is non-negligible yet meaningfully below the predetermined load. Then, if an operator inadvertently pushes the release button while the full 1000 pounds remains on the gripper, the release force would be insufficient to release the gripper. Thus, the interlock system and apparatus is preferably adapted to override a release command by an operator. When a second gripping mechanism properly grips the tubular, however, the first gripper is relieved of most of the tubular weight and it no longer holds the full 1000 pounds, and the applied release force of 100 psi is then typically more than sufficient to release the first gripper's grip (i.e., the load transfers from the first gripper to the second gripping mechanism). The first and second gripping mechanisms may be independently selected to be in the rig floor or operably connected to the top drive, e.g., as part of a casing running tool, pipe elevator, pipe slips, or the like, and typically one is in the rig floor and the other is operably connected to the top drive. In one embodiment, the interlock system measures a tubular load at the second gripping mechanism instead of the first, and operably associated with the rig floor. Additional gripping mechanisms may also be included in the drilling apparatuses, systems, and methods of the invention, such as having two, three, four, or more gripping apparatuses operatively connected to the top drive or rig floor.

The controller may include a programmable central processing unit that is operable with a memory, a mass storage device, an input control unit, and a display unit. Additionally, the controller may include well-known support circuits such as power supplies, clocks, cache, input/output circuits and the like. The controller is adapted to receive data from other devices and adapted to control devices connected thereto. An exemplary controller is a computer configured to receive data from a top drive and rig floor apparatus regarding gripping mechanism parameters, such as tubular load, rotational and other operational information, and the like. The data can, of course, be in the form of raw data, such as counterbalance piston pressure in psi, which can be converted to a tubular load in pounds for other calculations, display, or the like. By the term "controller" it should be understood that this can be either a single device or a plurality of devices that are operably linked to exchange information so as to effectively function as a unified controller for purposes of conducting the interlock functionality described herein. Additionally, use of multiple interlinked controllers may be used so that one may act as a verification check on the measurement of the other, which can help spot erroneous readings or faulty measurement devices.

In one embodiment, during makeup (of a tubular joint to the tubular string), counterbalance cylinders 90 are activated to compensate for the change in axial distance as a result of the threaded engagement. As the makeup occurs, the counterbalance cylinders are pulled downwards to permit the top drive and tubular string to remain in fixed position. An exemplary cylinder 90 is a piston and cylinder assembly. The piston and cylinder assembly may be actuated hydraulically, pneumatically, or by any other manner known to a person of ordinary skill in the art.

The cylinders 90 provide incremental axial movement of the gripping mechanism 70 so that the tubular joint being connected remains firmly gripped. The cylinders 90 may also be utilized to gather additional information about the tubular load on the gripping mechanism 70. The cylinders 90 can be configured to help measure the load and the predetermined load. The cylinders 90 are preferably pressurized hydraulic cylinders, such that the pressure applied to the cylinders as the tubular segment and gripping mechanism are pulled downwards during makeup is proportional to the weight of the tubular. The greater the weight of the tubular, the proportionately greater the pressure on the cylinders 90, which pressure can be used to then calculate the weight of the tubular.

The tubular load can also be measured, e.g., by determining the position of the cylinders 90, and particularly, the change in their position. The counterbalance cylinders are in a neutral, typically middle position between top and bottom, when not bearing a tubular load. Once a tubular is gripped, the counterbalance cylinders 90 will float to the bottom (i.e., be extended), and the speed of position displacement of the lower portion of the cylinders 90 (relative to the top part) based on the tubular weight may be measured and used to indirectly calculate weight of the tubular. Thus, if counterbalance cylinder(s) fall (or extend), an actual tubular load is present; if the cylinder(s) rise (or retract), an actual tubular load has been reduced. The counterbalance cylinder position, or associated sensor, can then provide input to the controller to indicate that weight has transferred and in which direction. This can be used independently from a position-based determination of the tubular weight, or in addition to such a position-based determination to provide for error checking. The controller can alternatively or additionally measure the additional pressure required to be applied to the hydraulic fluid or other mechanism to hold the counterbalance in the same position even with the added weight, and the change in pressure can be measured and used to calculate the proportional load. Additionally, a pressure can be applied to balance the at least one counterbalance cylinder against the actual tubular load to inhibit or prevent the cylinder(s) from fully extending to compensate for the weight of the actual tubular load being gripped, and the actual load is determined by calculating the weight based on the pressure applied. In these embodiments, no sensors or external equipment are thus required for the interlock system of the invention to operate. Thus, the position-based measurement may also be considered a weight-based system, albeit an indirect weight-based measurement. Other position-based systems that are an indirect weight-based system can be envisioned and are encompassed by the invention, as well.

Figure 2A:
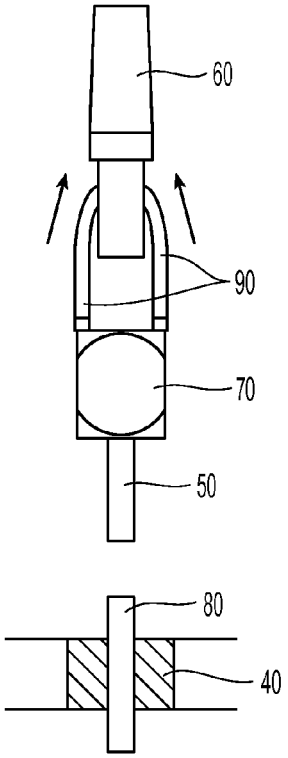
FIGS. 2A-2D illustrate the steps in a tubular makeup process according to one or more aspects of the present disclosure.
Figure 2B:
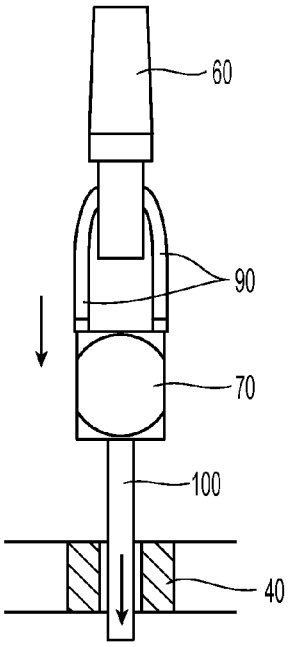

A preferred method of operation will now be described in further detail. The floor gripping device 40 initially holds the tubular string 80. Referring to FIG. 2A, before the top drive 60 threads the tubular 50 to the tubular string 80, the cylinders 90 exert a slight upward force on the tubular 50 to almost or actually match the weight of the tubular to inhibit or prevent the tubular 50 from smashing down onto the top of the tubular string 80 and damaging the threads at the top of the tubular string 80 when lowered. The top drive rotates and is slowly lowered, until the end of the tubular to be threaded onto the string makes contact with an upper end of the string. The top drive then rotates to threadedly engage the tubular 50 and tubular string 80. Referring to FIG. 213, once the connection is made, the top drive (or the cylinders, or both) can be moved slightly upwards (not shown) to ensure the one gripping device supports the tubular string weight. The upwards movement in this embodiment (not shown) facilitates a transfer of weight to the gripping device operably associated with the top drive. Likewise, when transferring the tubular weight to the floor gripping device, the tubular string is preferably lowered slightly before the floor device can engagingly grip to relieve the weight from the top drive gripping device. The slight movement, in either case, may be on the order of about 0.1 mm to 100 cm so long as it is sufficient to transfer the gripping engagement of the actual tubular load.

The whole load of the tubular string 100 is now held by the gripping mechanism 70. The floor gripping device 40 can now be disengaged from the tubular string 100. In a preferred embodiment, the interlock system of the present invention can be applied to ensure the gripping mechanism 70 is holding the tubular string 100 before the floor gripping device 40 is released as noted above. Then, the cylinders 90 can be adapted to measure that an actual load is present on the gripping mechanism 70, and this data is preferably sent to the controller. The controller sets a release force (e.g., based on the predetermined load) that is required to release the gripping mechanism at a level that is less than the release force required to release the measured (e.g., actual) load. This is done for safety reasons, for example, so that even if an operator were to inadvertently push the release button before the floor gripping device 40 is gripping the tubular string 100, the tubular string 100 will remain gripped by the gripping mechanism 70. This is because no release will occur even if the release force is applied, because it is not sufficient to actually release the gripping device unless a sufficient amount of the actual load is transferred to and carried by at least one other gripping device. The top drive 60 lowers the tubular string 100 into the wellbore and through the disengaged floor gripping device 40. At the top of the tubular string 100, the floor gripping device 40 reengages the tubular string 100. Once the floor gripping device 40 has a sufficient hold on the tubular string 100, a release force is applied to the other gripping mechanism 70, axially along the length, radially inwards or outwards, or both, to the tubular string 100. This transfers the tubular load from the top drive 60 to the floor gripping device 40.

Figure 2C:
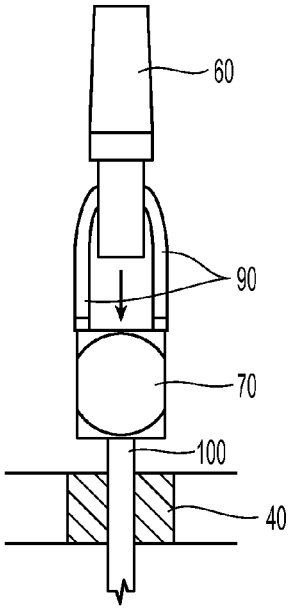
Figure 2D:
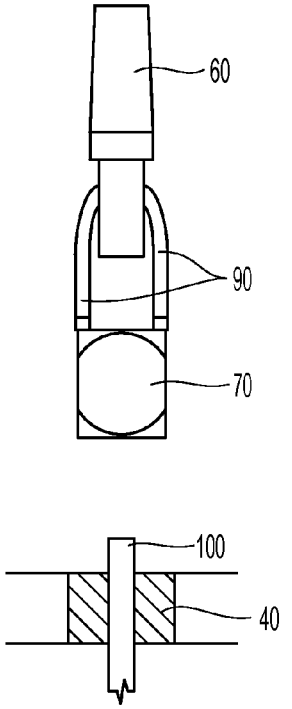

In one preferred embodiment, as seen in FIG. 2C, a downward force is applied to the gripping mechanism 70 while the tubular string 100 remains fixed by the floor gripping device 40. If it is not gripping, no release force is typically applied, and no release of the gripping mechanism 70 occurs. When the tubular string 100 is properly held by another gripping device, such as the floor gripping device 40, the release force releases engagement of the tubular string 100 from the gripping mechanism 70 as seen in FIG. 2D, and then the top drive 60 and the gripping mechanism 70 can be raised and the process is repeated, or any other suitable movement of the top drive and gripping mechanism 70 can be coordinated to facilitate cycling through to handle joining another tubular section to the tubular string 100. It should be understood that the interlock device will also work with respect to the opposite break-out procedures, such as when tubulars are removed from the string, and the apparatus, system, and method to achieve this reverse break-out function are also encompassed within the scope and spirit of the invention described herein.

Figure 3:
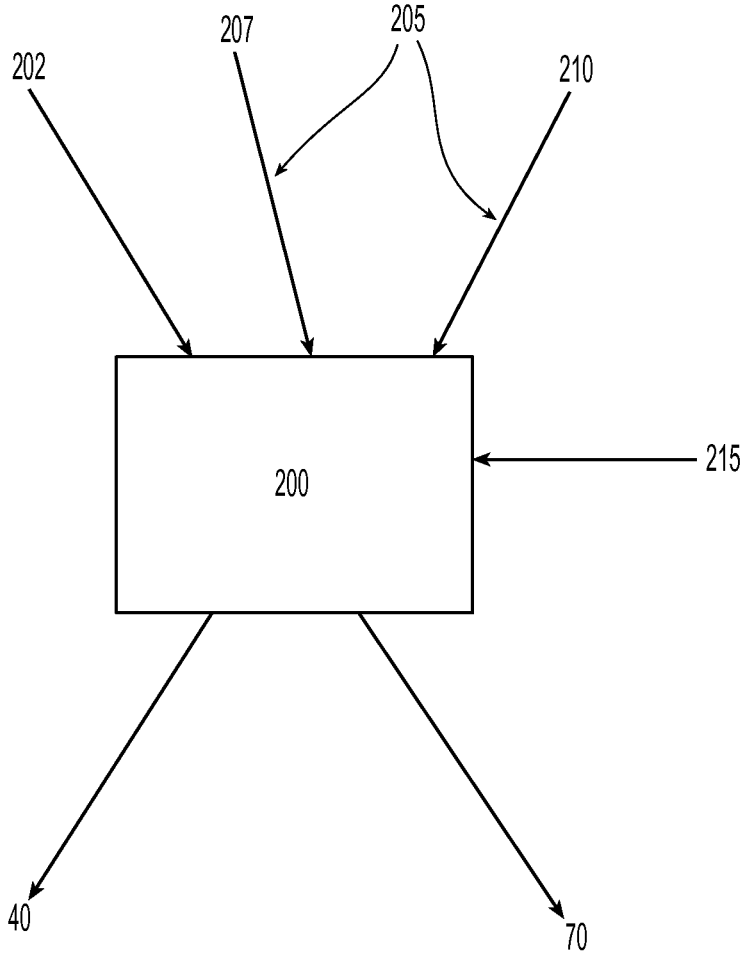
FIG. 3 illustrates a schematic where a controller receives signals from a sensor and transmits signals to a gripper.

FIG. 3 depicts an embodiment where a controller 200 receives signals from at least one of a weight-based sensor 202 or a position-based sensor 205. The position-based sensor 205 of this embodiment indirectly detects weight by determining if a portion of the entire apparatus has been moved due to the weight applied by a tubular load. This may be a gripping device position sensor 207, a counterbalance cylinder position sensor 210, or both. The controller 200 processes the information from one or more of these sources, calculates a release force and compares the actual tubular load measured by at least one sensor 202, 205 to the predetermined load, and when the condition is met the controller can be configured to transfer the weight and release the gripping component that transferred the weight to the other. Thus, the controller can be configured to (1) automatically issue the command to transfer the weight between a first gripping device 40 and a second gripping mechanism 70 and then apply the release force to release the first gripping component only after the tubular load has been decreased to no greater than the predetermined load; (2) not to apply the release force to either the first gripping device 40 or the second gripping mechanism 70 until the weight transfer from one to the other is detected through one of the input signals from a sensor, even when an operator issues a release command 215; or (3) both.

In another embodiment, the gripping device itself may be movable and an integrated or added sensor component can detect the position of the gripping device itself. Thus, when the gripper is not holding a tubular, it will be in a neutral position. When it is actually engaged and gripping (i.e., holding a sufficient weight of the tubular so that the system can determine the tubular will be held), the gripping device will be in a second position, which is typically lower than the first one due to the weight of the tubular. Of course, through a powered arrangement such as a hydraulic cylinder, intensifier, or the like, the weight could be arranged to cause the gripping device to be raised when gripping the weight. Either way, a change in the position of the gripping device can be used to measure and at least indirectly detect that sufficient weight of a tubular has been gripped that the interlock system described herein can then disengage at least a second gripping device.

In one embodiment, the method includes applying the release force only after the tubular load has sufficiently transferred from the gripping mechanism to the second gripping mechanism. In another embodiment, the full release force is applied after the load transfer is detected instead of applying only a reduced release force designed to exceed only the predetermined release force amount. The invention in one embodiment encompasses an interlock system, apparatus, and methods that detect actual tubular load directly or indirectly regardless of detection of whether a gripping mechanism is engaged with a tubular or not.

The term "about," as used herein, should generally be understood to refer to both numbers in a range of numerals. Moreover, all numerical ranges herein should be understood to include each whole integer within the range.

The terms "gripping," "grip," or "gripped," as each used herein, means the accepting and holding at least a substantial portion or all of the actual load.

Although preferred embodiments of the invention have been described in the foregoing description, it will be understood that the invention is not limited to the specific embodiments disclosed herein but is capable of numerous modifications by one of ordinary skill in the art. It will be understood that the materials used and the mechanical details may be slightly different or modified from the descriptions herein without departing from the methods and devices disclosed and taught by the present invention.

What is claimed is:

1. A weight-based tubular interlock apparatus adapted to determine whether a tubular is engagingly gripped by a rig-based hoisting device or a gripping device, which comprises:

a first gripping mechanism operably associated with the rig-based hoisting device or the gripping device, the first gripping mechanism being adapted to grip the tubular so as to support a weight of the tubular; and an interlock system operatively connected thereto that is adapted:

to measure a load experienced by the first gripping mechanism that changes when a second gripping mechanism carries a portion of a total tubular load, to store a predetermined portion of the total tubular load that, when met, provides confirmation that the first or the second gripping mechanism is gripping the tubular, and to compare the load experienced by the first gripping mechanism to the predetermined portion of the total tubular load to determine whether the first gripping mechanism is gripping the tubular, wherein the interlock system is also adapted to calculate a sufficient release force based on the predetermined portion of the total tubular load, the sufficient release force being a force that when met opens the first gripping mechanism to release the tubular, and wherein the apparatus is adapted to apply the sufficient release force to the first gripping mechanism, the first gripping mechanism being adapted to release the tubular only when the load experienced by the first gripping mechanism is at or reduced below the predetermined portion of the total tubular load.

2. The apparatus of claim 1, which further comprises at least one counterbalance mechanism adapted to provide incremental axial movement of the tubular relative to a rig-based hoisting device wherein the at least one counterbalance cylinder measures the tubular load.

3. The apparatus of claim 2, wherein at least one counterbalance mechanism comprises at least one counterbalance cylinder.

4. The apparatus of claim 3, wherein the at least one counterbalance cylinder measures the tubular load.

5. The apparatus of claim 1, wherein the apparatus is further configured to apply the sufficient release force in an amount that is less than the force needed to release the total tubular load, but sufficient to release the predetermined portion of the total tubular load.

6. The apparatus of claim 1, wherein the predetermined portion of the total tubular load is met when the second gripping mechanism is engagingly gripping the tubular and carrying at least a majority of the total tubular load.

7. The apparatus of claim 6, wherein the second gripping mechanism is operably associated with the rig floor device when the first gripping mechanism is operably associated with the rig-based hoisting device.

8. The apparatus of claim 6, wherein the interlock system is electronically associated with the first gripping mechanism and second gripping mechanism, and is adapted to confirm the total tubular load is engagingly gripped by at least one of the first gripping mechanism and second gripping mechanism before releasing the other of the first gripping mechanism and second gripping mechanism.

9. A drilling rig comprising the interlock apparatus of claim 1.

10. The apparatus of claim 1, wherein the load experienced by the first gripping mechanism is entirely an axial load and the sufficient release force includes at least an axial component.

11. The apparatus of claim 1, wherein the load experienced by the first gripping mechanism is reduced below the predetermined portion of the total tubular load when the load experienced by the first gripping mechanism falls within a range of acceptable loads to confirm the tubular is gripped by the second gripping mechanism.

12. The apparatus of claim 1, wherein the interlock system is integrally formed with the first gripping mechanism.

13. A method to ensure that a tubular is engagingly gripped by a rig-based hoisting device or a gripping device, which comprises:

gripping a tubular with a first gripping mechanism operably associated with the rig-based hoisting device;

measuring a load experienced by the first gripping mechanism that changes when a second gripping mechanism carries a portion of a total tubular load;

comparing the load experienced by the first gripping mechanism to a predetermined portion of the total tubular load that, when met, provides confirmation that the first or second gripping mechanism is gripping the tubular;

calculating a first release force that is less a second release force needed to release the total tubular load, the first release force being based on the predetermined portion of the total tubular load;

applying the first release force to the first gripping mechanism; and releasing the first gripping mechanism's engaging grip on the tubular if the load experienced by the first gripping mechanism is no greater than the predetermined portion of the total tubular load.

14. The method of claim 13, wherein the load experienced by the first gripping mechanism is entirely an axial load and wherein the first release force includes at least an axial component.

15. The method of claim 13, which further comprises calculating the second release force needed to release the total tubular load.

16. The method of claim 15, wherein the first release force is set to about 10 to 90 percent of the second release force so that the first release force can be applied to release the tubular from the first gripping mechanism when the total tubular load is decreased sufficiently.

17. The method of claim 15, wherein the load experienced by the first gripping mechanism is measured by a load cell operatively connected to the first gripping mechanism, the position of at least one counterbalance cylinder, the measured or calculated force on at least one counterbalance cylinder, or any combination thereof.

18. The method of claim 13, further comprising applying the first release force axially in the upwards direction to the tubular, in a downwards direction to the first gripping mechanism, radially inwards or outwards, or any combination thereof.

19. The method of claim 13, wherein the second gripping mechanism grips the tubular sufficiently so that the load experienced by the first gripping mechanism is no greater than the predetermined portion of the total tubular load.

20. The method of claim 13, which further comprises applying a third release force to the tubular relative to the first gripping mechanism.

21. A method to inhibit or prevent undesired release of a tubular during operation of a rig, which comprises:

gripping a tubular with a first gripping mechanism operably associated with a rig-based hoisting device;

measuring a load experienced by the first gripping mechanism that changes when a second gripping mechanism carries a portion of a total tubular load;

calculating a force required to release the total tubular load;

setting a release force at less than the force required to release the total tubular load; and applying the release force to the tubular relative to the first gripping mechanism, wherein the load experienced by the first gripping mechanism is not released unless the second gripping mechanism sufficiently grips the load experienced by the first gripping mechanism so that the load experienced by the first gripping mechanism is less than a predetermined portion of the total tubular load.

22. The method of claim 21, wherein the second gripping mechanism is operably associated with a rig floor device and decreases the load on experienced by the first gripping mechanism so that the release force can be applied to release the tubular from the first gripping mechanism.

23. The method of claim 21, wherein the release force is set to about 10 to 90 percent of the force need to release the total tubular load so that the release force can be applied to release the tubular from the first gripping mechanism when the load experienced by the first gripping mechanism is decreased sufficiently.

24. The method of claim 21, wherein the release force is applied in the upwards direction to the tubular, a downwards direction to the first gripping mechanism, or both.

25. The method of claim 21, further comprising gripping the tubular sufficiently with the second gripping mechanism so that the load experienced by the first gripping mechanism is no greater than the predetermined portion of the total tubular load.

26. A drilling apparatus, which comprises, a rig-based hoisting device with a first gripping mechanism operatively associated therewith;

a second gripping mechanism operatively associated with a rig floor; and an interlock system integrally formed with the first gripping mechanism and second gripping mechanism that is adapted to confirm a total tubular load is engagingly gripped by at least one of the first and second gripping mechanism before releasing the other of the first and second gripping mechanism, wherein the first and second gripping mechanisms are adapted to release the tubular only when the load experienced by at least one of the first and second gripping mechanisms meets a predetermined portion of the total tubular load that, when met, provides confirmation that at least one of the first or second gripping mechanisms is gripping the tubular, and only a release force less than that force needed to release the total tubular load and based on the predetermined portion of the total tubular load and sufficient to release the tubular from the first or second gripping mechanism is applied to the tubular relative to the first or second gripping mechanism, wherein the interlock system is adapted to apply the release force to the first or second gripping mechanism, and adapted to release the one of the first and second gripping mechanisms' grip on the tubular if the load experienced by the first or second gripping mechanism is no greater than the predetermined portion of the total tubular load.

27. The apparatus of claim 26, wherein at least one counterbalance cylinder measures the load experienced by the first gripping mechanism.

28. The apparatus of claim 26, wherein the release force is less than the force needed to release the load experienced by the first or second gripping mechanisms, but sufficient to release the predetermined portion of the total tubular load.

29. A method to inhibit or prevent release of a tubular during rig operation, which comprises:

gripping a tubular with a first gripping mechanism operably associated with a rig-based hoisting device;

measuring a load experienced by a second gripping mechanism that changes when the first gripping mechanism carries a portion of a total tubular load to determine if the tubular is being gripped;

calculating a release force less than a force needed to release total tubular load, the release force being based on a predetermined portion of the total tubular load; and applying the release force sufficient to release the tubular from the first gripping mechanism, wherein the load experienced by the first gripping mechanism is not released unless the second gripping mechanism is gripping the load experienced by the first gripping mechanism.

30. The method of claim 29, wherein the measured load experienced by the second gripping mechanism is compared to a pre-set value to confirm the second gripping mechanism is gripping the tubular.

31. The method of claim 29, which further comprises measuring a load experienced by the first gripping mechanism; and comparing the measured load experienced by the first and second gripping mechanisms to determine that the tubular is sufficiently gripped by the second gripping mechanism before applying the release force.

* * * * *